United States Patent [19]

Klaren

[11] 4,220,193

[45] Sep. 2, 1980

[54] METHOD AND EQUIPMENT FOR HEAT EXCHANGE

[75] Inventor: Dick G. Klaren, Hillegom, Netherlands

[73] Assignee: Esmil, B.V., Amersfoort, Netherlands

[21] Appl. No.: 895,056

[22] Filed: Apr. 10, 1978

[30] Foreign Application Priority Data

Apr. 12, 1977 [NL] Netherlands ..... 7703939

[51] Int. Cl.[2] ..... F28C 3/16

[52] U.S. Cl. ..... 165/1; 34/57 A; 165/104 F

[58] Field of Search ..... 165/104 F, 1; 34/57 A

[56] References Cited

U.S. PATENT DOCUMENTS 2,919,118 12/1959 Hunter ..... 165/104 F 3,991,816 11/1976 Klaren ..... 165/104 F X

FOREIGN PATENT DOCUMENTS 1442783 1/1969 Fed. Rep. of Germany ..... 165/104 F

*Primary Examiner*—Albert W. Davis

*Attorney, Agent, or Firm*—Stevens, Davis, Miller & Mosher

[57] ABSTRACT

A method of heat exchange in a heat exchanger which has a plurality of upwardly extending pipes for upward flow of a primary liquid medium and around which in operation a secondary medium flows, a lower chamber at the lower ends of the pipes from which the primary liquid enters the pipes and which contains a distribution system adapted to distribute flow across the cross-section of the lower chamber, and an upper chamber at the upper ends of the pipes into which the fluid passes from the pipes, the pipes and the upper and lower chambers containing fluidizable particulate material, in which method the flow-rate of the primary liquid medium is selected so that the particulate material is fluidized within the pipes and within the upper and lower chambers without mechanical stirring, the distribution system causes the primary liquid medium to be admitted to the pipes substantially uniformly across the transverse cross-section of the lower chamber and the pressure drop ($\Delta P_d$) across the distribution system and the pressure drop ($\Delta P_b$) caused by all of the particulate material satisfy the condition:

$$0.01 < \Delta P_d \cdot 100/\Delta P_b < 400.$$

8 Claims, 2 Drawing Figures

METHOD AND EQUIPMENT FOR HEAT EXCHANGE

The invention relates to a method of heat exchange and to a heat exchanger for performing the method.

A method of heat exchange and a heat exchanger are described in German Offenlegungsschrift No. 2,552,891, mainly with reference to the performance of a chemical reaction on a solid matter with the aid of a gaseous liquid agent. In the heat exchanger disclosed, heat exchange takes place between a primary fluid medium, which passes through parallel pipes vertically upwardly, and a secondary fluid medium which flows around the pipes, while in the pipes and in the chambers adjoining at the top and bottom ends thereof the primary fluid medium flows through a particulate material and keeps this in a fluidised condition in the pipes.

In this known application, mechanical stirring device are used in the upper and lower chambers. Their function here is primarily to prevent channel formation in the particulate material in the chambers, in order that the distribution of the gaseous primary fluid among the pipes should be haphazard. Another function of the stirring devices is to avoid uneven and uncontrolled deposit on the particulate material, which is subject to chemical conversion.

It has appeared that this use of stirring devices results in high costs of investment, operation and maintenance of the plant. Particularly if the heat-exchanger were used in an evaporation plant for salt or brackish water for the purpose of producing drinking water or process water, these additional costs would prove to make the plant considerably more expensive and the method more complicated.

It is pointed out that heat exchange methods and heat-exchangers in which granular material is fluidized in vertical pipes are known in fresh water production, e.g. from U.S. Pat. No. 3,991,816. The solid particles are intended by their presence in a fluidised condition to improve heat exchange between the pipe wall and the primary fluid medium at low velocity of the latter.

A considerable disadvantage of the heat-exchanger of this U.S. patent is the existence of a throttle device at the inlet of each heat-exchanger pipe. This throttle device is necessary to fluidise the filling of solid particles evenly in all the pipes up to the upper chamber for the primary fluid. It has been shown by testing with a heat-exchanger following this principle that its proper functioning depends to a large extent on the manner in which the throttle devices are susceptible to becoming blocked. If a throttle device gets blocked, the pipe in question will be completely filled with the particles from the layer of particles in the upper chamber, and the pipe in question is effectively eliminated from the heat exchange process. If after a period of time the number of blocked pipes forms a substantial part of the total heat exchanging surface, it may be necessary to suspend operation of the whole heat-exchanger in order to empty the pipes which are completely filled with solid particles and to remedy the cause of the blockage of the throttle devices of these pipes. It stands to reason that such a course of action with large heat exchangers with thousands of parallel pipes may be a cumbersome and time-consuming procedure even if only a small percentage of all the pipes is no longer active because their throttle devices are blocked up.

According to the invention in one aspect, there is provided a method of heat exchange in a heat exchanger which has a plurality of upwardly extending pipes for upward flow of a primary medium and around which in operation a secondary medium flows, a lower chamber at the lower ends of the said pipes from which the primary fluid enters the pipes and which contains a distribution system adapted to distribute flow across the cross-section of said lower chamber, and an upper chamber at the upper ends of the pipes into which the fluid passes from the pipes, the pipes and the upper and lower chambers containing fluidisable particulate material, in which method the flow-rate of the primary medium is selected so that the particulate material is fluidised within the pipes and within the upper and lower chambers without mechanical stirring, the distribution system causes the primary medium to be admitted to the pipes substantially uniformly across the transverse cross-section of the lower chamber and the pressure drop ($\Delta P_d$) across the distribution system and the pressure drop ($\Delta P_b$) caused by all of the particulate material satisfy the condition:

$$0.01 < \Delta P_d \cdot 100/\Delta P_b < 400.$$

According to the invention in another aspect there is provided a heat exchanger suitable for carrying out the method of the invention as described above.

It is apparent that, in the method of the invention, formation of preference flows in the lower chamber is prevented or minimized, so that the supply of the fluidised particulate material at the lower apertures of the pipes is to a great extent uniform. Another result obtainable with the invention is that disparities in porosity of the fluidised particulate material may be very slight between the pipes, even if for this purpose a throttle device need not be used at the inlet of each pipe. All this can be accomplished without any stirring devices in the lower or upper space. It is also possible to avoid the use of throttling devices in the pipes.

It is evident that a considerably simpler plant may thus be obtained. An additional advantage of this plant over one with throttle devices at the inlets of the pipes is that the entire resistance to flow of the primary fluid medium through the plant is considerably reduced. This results in energy saving.

With due regard for the above-mentioned condition which has to be met by $\Delta P_d$ and $\Delta P_b$, the risk of the occurrence of preference flows in the lower or upper chamber and the accompanying uneven distribution of the fluidised particulate material in the pipes can be further reduced if the pipes have at their lower ends elements providing inflow to the pipes, which elements are located below the upper side of the lower chamber. This inflow element may be attached to the pipe, or may be the lower end of the heat-exchanger pipe itself.

The inlet opening of the inflow element is preferably perpendicular to the centre line of the inlet element. Preferably also, inlet openings in said inflow elements are at least partly arranged so that flow through them is lateral. The inflow elements have the great advantage that the fluidised particulate material in the lower chamber lies clear of the pipe plate in which the pipes are secured. In this way, proper exchange of the particulate material between the pipes and the lower chamber is encouraged to a great extent, and additionally this exchange is rendered less susceptible to obliquity of the heat exchanger.

As already pointed out one of the functions of the particulate material within the pipes is to improve the heat transfer to and from the inside surface of the pipes. It will be clear that for a tangible effect on the heat transfer a certain minimum amount of the particulate material must be present in the pipes. However, as a result of the requirement that in the lower chamber the particulate material must also be fluidised, it is on the whole achieved that the porosity of the particulate material within the pipes rises sharply because the speed of the primary medium in the pipes is higher than in the lower chamber.

It has, however, now appeared that in spite of fluidisaton of the granular material in the lower chamber, especially satisfactory heat transfer in the pipes can be obtained if the transverse cross-sectional area of the lower chamber $A_o$ directly below the openings for inflow to the pipes and the sum of the inside cross-sections of all the pipes $A_p$ satisfy the following relation $$1.75 < A_o/A_p < 16$$

More preferably, $$1.85 < A_o/A_p < 8$$

To an expert in the field of fluidised beds there is no problem here in designing the cross-sectional area of the pipe bundle on this basis.

The heat-exchanger of the invention can be used for heat exchangers in which the particulate material remains unchanged. In this case it is sufficient that the exchanger is filled with this particulate material. The fluidised condition of the particulate material in the entire exchanger (which may be achieved with the invention), is, however, also particularly suitable when removing, supplying or replacing the material. In addition to simultaneous supply and removal of the filling, it is also possible only to supply or to remove the filling, via either the lower or the upper chamber. In this way the weight of the solid filling in the heat-exchanger can be varied.

The new apparatus also makes it possible to use a filling material whose particules grow as a result of the conditions of the process. This may for instance be the case if the heat exchanger is used to warm, in the pipes, a liquid which contains a solute which has a lower solubility at increased temperatures and will preferentially deposit on the filling material if this has a crystalline structure more or less similar to that of the solute. If the particles of the solid filling now grow, most of the particles of increased size will sink down the pipes and subsequently can be tapped from the lower chamber without interference in the operation of the heat exchanger.

If desired, two or more of the heat exchanger units of the invention can be stacked one on top of another and operated in series. The upper chamber of the bottom heat exchanger may then function at the same time as the lower chamber for the next heat exchanger above. The number of pipes and the inner diameter of the pipes may be different in each heat exchanger as long as proper exchange of the particulate material between lower chamber, upper chamber and pipes is guaranteed; it is also possible to use pipes with varying inner diameters for each heat exchanger.

In the fluidisation of the particulate material in the lower chamber of each heat exchanger, proper heat transfer can still be achieved in the pipes of this heat exchanger if for each heat exchanger the required ratio of the quantities $A_o$ and $A_p$ defined above is present.

The ratio for the pressure drops required by the invention also holds good for several heat exchangers placed one above another, wherein the pressure drop as a result of the mass of the fluidised particulate material relates to the particulate material of all the heat exchangers placed on top of each other.

The advantage of several heat exchanger units one above another is the possibility of building up a large heat exchanger surface from comparatively small units. By varying the number of pipes and/or the inner diameter of the pipes, the porosity of the fluidised particulate material in the pipes can also be varied between the heat exchangers and consequently may be adapted to the conditions obtaining in each.

Embodiments of the invention will now be described by way of example with reference to the accompanying drawings, in which.

Figure 1:
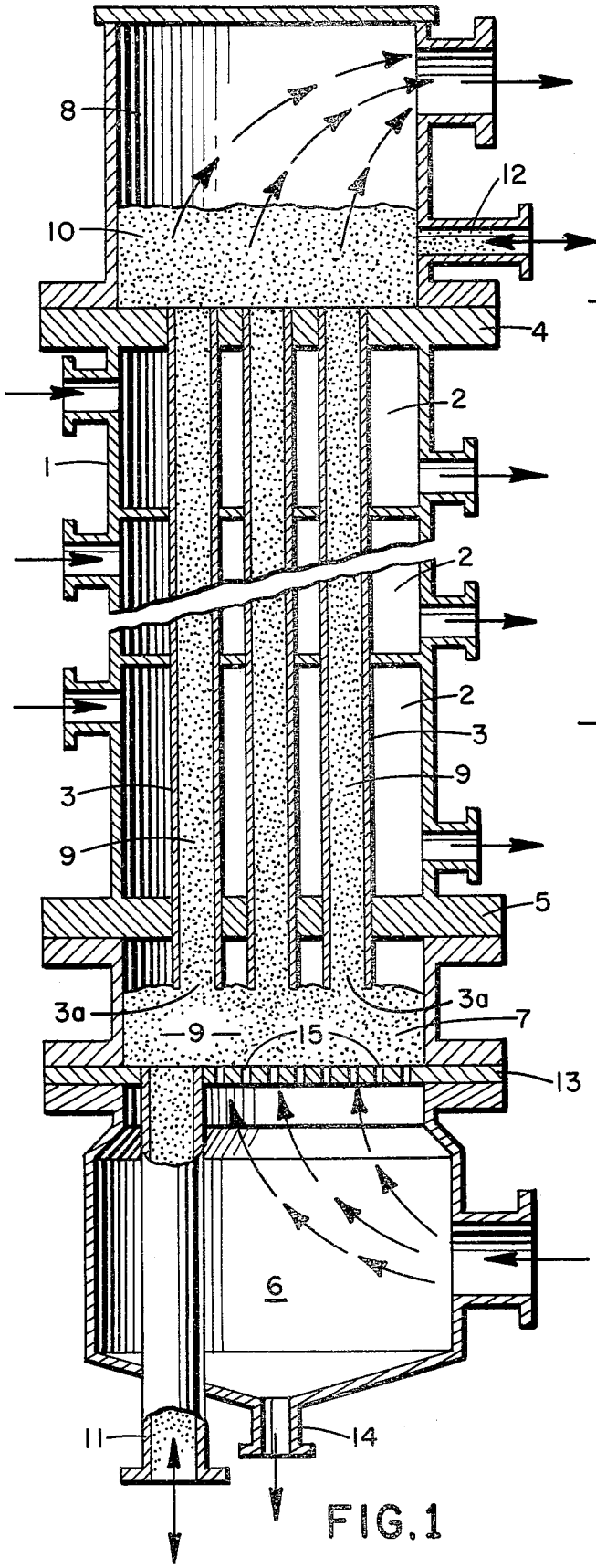
FIG. 1 shows a heat exchanger embodying the invention.

The heat exchanger of FIG. 1 has a casing 1 which is subdivided into several compartments 2. Through these pass parallel vertical heat exchanger pipes 3, which are fixed in pipe plates 4 and 5. The compartments 2 function as heat exchanger elements connected in series. Through them, outside the heat exchanger pipes 3 passes a secondary medium (which in itself may differ from one compartment 2 to another), while a primary medium flows via a lower chamber consisting of two chamber parts 6 and 7 in an upward direction through inflow openings **3*a* and next through the heat exchanger pipes 3 to an upper chamber 8. The primary medium must of course be the same for all compartments 2**.

The heat exchanger pipes 3 of the pipe bundle can be normal smooth cylindrical pipes. The pipes can also be grooved or they may be provided with fins on the outside. For pipes with grooves on the inside it is desirable that the radius of curvature at the bottom of each groove is larger than the dimensions of the particles of a particulate filling material 9, with which the pipes 3 are filled and which in use is kept in a fluidised condition by the upward flow of liquid.

At the top, the heat exchanger pipes 3 are in an open communication with the upper chamber 8 in which there is a layer 10 of the particulate filling, the particles of which are also fluidised.

In the lower and upper chambers particulate material 9 can be supplied or removed via conduits 11 and/or 12, respectively. The solid particles in the chamber 7 which are in a fluidised condition are prevented from reaching the lower chamber 6 by a distribution plate 13 which has apertures 15 for passage of the flowing liquid; the plate 13 may suitably be equipped with tuyeres, not shown. For reasons of strength, it may be advisable to curve the distribution plate 13 slightly.

The purpose of the distribution plate 13 is to bring about a uniform flow at the pipe plate 5 over the whole area, for which purpose it is necessary that the liquid suffers a pressure decreases when passing through the distribution plate 13.

The lower chamber 6 has a drain 14 for the removal of any dirt which may have accumulated in this compartment. If the primary liquid is polluted it may be advisable for the maximum transverse cross-section of the chamber 6 to be much larger than the transverse cross-section of the chamber 7, since this induces the deposit of dirt as well as reducing the risk of obstruction of the apertures 14 in the distribution plate 13.

In the embodiment illustrated, a stable and easily controllable process was obtained in the following manner:

Seawater was supplied to the lower chamber of a heat exchanger consisting of sixty-one $\frac{3}{4}$ inch pipes; the seawater was heated in successive compartments by supplying steam to the outside of the pipes.

The pressure drop caused by the distribution system 13 amounted to approximately 20% of the pressure drop caused by the weight of the fluidised particulate material in the heat exchanger.

The passage (throughflow area) of the lower chamber direct below the lower openings of the pipes was only about 2.7 times the total passage of the heat-exchanger pipes. At a flow speed in the pipes of approximately 0.12 m/s, the particulate material in the pipes fluidised with a porosity of about 80%, while the porosity of the likewise fluidised particulate material in the lower chamber amounted to about 45%. All the pipes were provided with an inflow piece projecting below the top side of the lower chamber.

Figure 2:
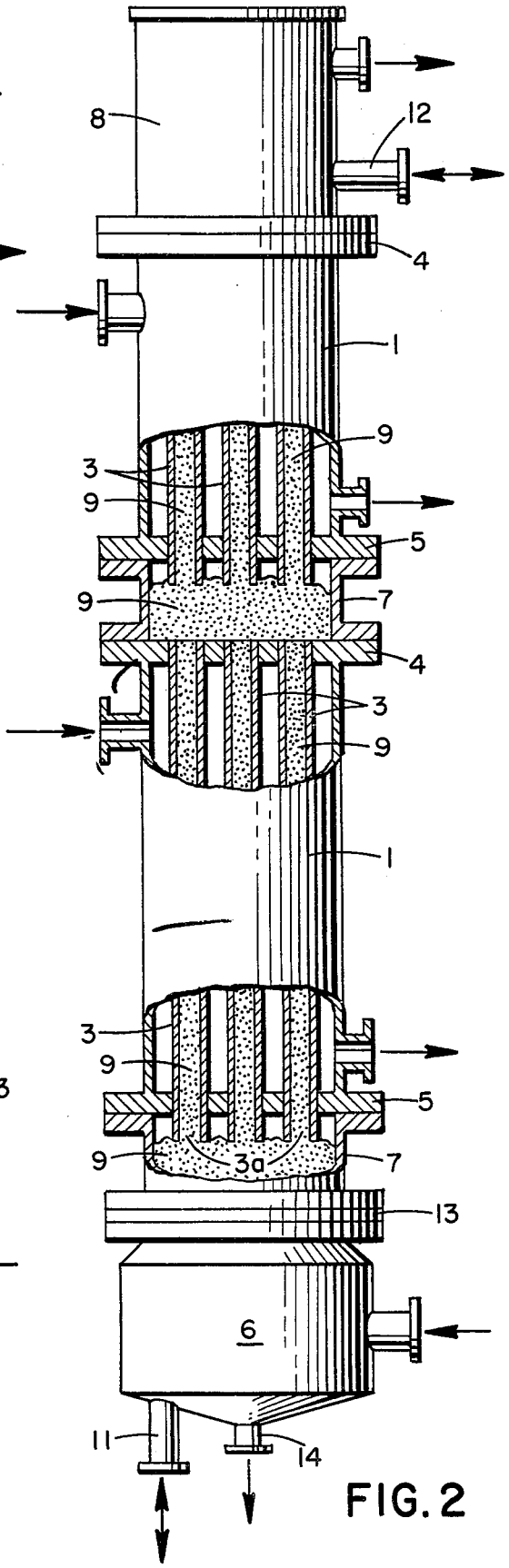
FIG. 2 shows two such heat exchanger units placed one on top of the other.

FIG. 2 shows two heat exchangers as illustrated in FIG. 1 placed one on top of the other, with the upper chamber of the bottom heat exchanger also functioning as the lower chamber of the top heat exchanger.

What we claim is:

1. A method of heat exchange in a heat exchanger which has a plurality of upwardly extending pipes for upward flow of a primary liquid medium and around which in operation a secondary medium flows, a lower chamber at the lower ends of the said pipes from which the primary liquid enters the pipes and which contains a distribution system adapted to distribute flow across the cross-section of the lower chamber, and an upper chamber at the upper ends of the pipes into which the fluid passes from the pipes, the pipes and the upper and lower chambers containing fluidisable particulate material, in which method the flow-rate of the primary liquid medium is selected so that the particulate material is fluidised within the pipes and within the upper and lower chambers without mechanical stirring, the particulate material being free to expand in said upper chamber, the distribution system causes the primary liquid medium to be admitted to the pipes substantially uniformly across the transverse cross-section of the lower chamber and the pressure drop ($\Delta P_d$) across the distribution system and the pressure drop ($\Delta P_b$) caused by all of the particulate material satisfy the condition:

$$0.01 < \Delta P_d \cdot 100/\Delta P_b < 400.$$

2. A method according to claim 1 wherein the said pressure drops $\Delta P_d$ and $\Delta P_b$ satisfy the condition:

$$0.025 < \Delta P_d \cdot 100/P_b < 50.$$

3. Apparatus for heat exchange between a liquid passing through tubes and a second medium outside having a plurality of upwardly extending pipes for upward flow of liquid and around which in operation a secondary medium flows, a lower chamber at the lower ends of the said pipes from which said liquid enters the pipes and which contains a distribution system adapted to distribute flow across the cross-section of said lower chamber, and an upper chamber at the upper ends of the pipes into which the liquid passes from the pipes, said upper chamber defining inlet and outlet means in direct communication with said pipes for supplying or removing particulate material, said upper chamber being free from mechanical restriction to the expansion of said particulate material, the pipes and the upper and lower chambers containing fluidisable particulate material, wherein the dimensions and arrangement of the pipes, the upper and lower chambers, the distribution system and the particulate material are such that at at least one flow rate of the liquid and in the absence of mechanical stirring of the particles in the upper and lower chambers, the particulate material is fluidised in the pipes and in the upper and lower chambers, the distribution system causes the liquid to be admitted to the pipes substantially uniformly across the transverse cross-section of the lower chamber and the pressure drop ($\Delta P_d$) across the distribution system and the pressure drop ($\Delta P_b$) caused by all of the particulate material satisfy the condition:

$$0.01 < \Delta P_d \cdot 100/\Delta P_b < 400.$$

4. A heat exchanger according to claim 3 wherein at said at least one flow rate of the primary medium, the said pressure drops $\Delta P_d$ and $\Delta P_b$ satisfy the condition:

$$0.025 < \Delta P_d \cdot 100/\Delta P_b < 50.$$

5. A heat exchanger according to claim 3 or claim 4 wherein all elements providing inflow to the pipes from the lower chamber are located below the upper side of the lower chamber.

6. A heat exchanger according to claim 5 wherein the pipes extend downwardly from the said upper side of the lower chamber to their lower ends which constitute said inflow elements.

7. A heat exchanger according to claim 3 wherein the transverse cross-sectional area $A_o$ of the lower chamber immediately below the openings for inflow of primary fluid to the pipes and the total interior transverse cross-sectional area $A_p$ of the pipes satisfy the condition:

$$1.75 < A_o/A_p < 16$$

8. A heat exchanger according to claim 7 wherein the said cross-sectional areas $A_o$ and $A_p$ satisfy the condition $$1.85 < A_o/A_p < 8.$$

* * * * *